US007405373B2

(12) United States Patent
Konishi et al.

(10) Patent No.: US 7,405,373 B2
(45) Date of Patent: Jul. 29, 2008

(54) SWITCH STRUCTURE AND ELECTRONIC DEVICE

(75) Inventors: Hiroyuki Konishi, Chiba (JP); Hisashi Fujieda, Chiba (JP); Fumiyoshi Nagakura, Chiba (JP); Akiko Asahata, Chiba (JP); Masaji Kondo, Chiba (JP); Shigeki Yagi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/805,197

(22) Filed: May 21, 2007

(65) Prior Publication Data

US 2008/0023316 A1 Jan. 31, 2008

(30) Foreign Application Priority Data

Jul. 26, 2006 (JP) ..... 2006-203193

(51) Int. Cl.
*H01H 1/10* (2006.01)

(52) U.S. Cl. ..... 200/517; 200/293; 200/341; 200/1 R

(58) Field of Classification Search ..... 200/512–517, 200/520, 293, 296, 341–345, 1 R, 4, 5 R
See application file for complete search history.

(56) References Cited

U.S. PATENT DOCUMENTS 5,552,956 A * 9/1996 Pasquarette et al. ..... 361/680
5,564,560 A * 10/1996 Minelli et al. ..... 200/516
6,201,202 B1 * 3/2001 Katagiri ..... 200/513
6,375,879 B1 * 4/2002 Horiuchi ..... 264/105
6,570,111 B2 * 5/2003 Nakagawa et al. ..... 200/343
7,115,827 B2 * 10/2006 Tseng ..... 200/341

* cited by examiner

*Primary Examiner*—K. Richard Lee
(74) *Attorney, Agent, or Firm*—Adams & Wilks

(57) ABSTRACT

The switch structure according to the present invention is obtained by interposing an elastic connection member between the circuit board provided with electrodes and a push switch fixed to a case of an electronic device. The elastic connection member has a structure in which conductive layers and insulation layers are alternately laminated. The conductive layers of a first lamination layer surface on which the conductive layers and the insulation layers of the elastic connection member are exposed abut against the electrodes so that the electric connections therebetween are established. The push switch is pushed down, and a contact portion thereof abuts against the plurality of conductive layers on a second lamination layer surface, whereby the electrodes are in a conductive state. Even if the push switch is pushed strongly, the elastic connection member deforms to absorb the force. As a result, the switch structure which hardly breaks is obtained.

9 Claims, 5 Drawing Sheets

SWITCH STRUCTURE AND ELECTRONIC DEVICE

BACKGROUND OF THE INVENTION

1. Field of the Invention

The present invention relates to a switch structure of an electronic device and an electronic device equipped with the switch structure.

2. Description of the Related Art

An electronic device such as a portable phone or an electronic metronomemay include a push-button-type side switch on a side surface thereof. FIG. 7 is a sectional view showing a constitutional example of a conventional side switch (see JP 2004-79503 A). As shown in FIG. 7, in a conventional side switch 23, a switch module 24, which is pushed so that the switch module freely moves forward and backward in a surface direction of a circuit board surface, is mounted on a circuit.

In the side switch 23 shown in FIG. 7, the switch module 24, which is pushed so that the switch module freely moves forward and backward in the surface direction of the circuit board surface, is soldered on an electrode formed on a circuit board 1. By pushing a push switch projecting portion 25 projecting from a push switch hole 22 formed in a case 21, the switch-module 24 becomes in an ON state.

In the conventional switch structure, in a case where the push switch projecting portion 25 is pushed by a force stronger than a force which is presumed when designing, the switch module 24 main body is pushed toward the surface of the circuit board. Therefore, there caused problems such that, in a case where the push switch projecting portion 25 is pushed strongly or an impact is given thereto, the switch module 24 itself may break, and the solder or the like for fixing the switch module 24 and the circuit board 1 may peel off. Accordingly, there is a problem in that, in the electronic devices including a side switch, the side switch easily breaks due to a drop impact.

SUMMARY OF THE INVENTION

Therefore, an object of the present invention is to provide a switch structure which hardly breaks even if the switch is pushed strongly and has a strong resistance to a drop impact, and an electronic device equipped with the switch structure.

In order to achieve the above-mentioned object, according to a first aspect of the present invention, there is provided a switch structure including: a circuit board; at least a pair of electrodes formed on the circuit board; a push switch provided to face an end surface of the circuit board, and having a contact portion which moves forward and backward; and an elastic connection member provided between the end surface of the circuit board and the contact portion, and has a structure in which conductive layers including a first conductive layer and a second conductive layer and insulation layers are laminated alternately, in which the elastic connection member is constituted such that, the first conductive layer abuts against one electrode of the pair of electrodes out of the plurality of electrodes, and the second conductive layer insulated from the first conductive layer abuts against another electrode of the pair of electrodes out of the plurality of electrodes, and when the push switch is pushed, the contact portion abuts against the first conductive layer and the second conductive layer so that electric connections therebetween are established.

Further, in order to achieve the above-mentioned object, according to a second aspect of the present invention, in the first aspect of the present invention, the electrodes are provided on the end surface of the circuit board.

Still further, in order to achieve the above-mentioned object, according to a third aspect of the present invention, in the first aspect of the present invention, the electrodes are provided on a circuit pattern formation surface of the circuit board, and abut against a lamination layer surface of the elastic connection member where the conductive layers and the insulation layer are exposed.

Yet further, in order to achieve the above-mentioned object, according to a fourth aspect of the present invention, in the third aspect of the present invention, the elastic connection member abuts against an opposite surface of the surface of the circuit board, on which the electrodes are formed.

Yet still further, in order to achieve the above-mentioned object, according to a fifth aspect of the present invention, in the third or fourth aspect of the present invention, the switch structure further includes a support member on an opposite surface of the surface of the circuit board, on which the electrodes are provided.

Yet still further, in order to achieve the above-mentioned object, according to a sixth aspect of the present invention, in the fifth aspect of the present invention, the support member has a length larger than a width of the elastic connection member, and includes a convex portion adjacent to the end surface of the elastic connection member.

Yet still further, in order to achieve the above-mentioned object, according to a seventh aspect of the present invention, in any one of the first to sixth aspects of the present invention, the elastic connection member includes the plurality of conductive layers and the plurality of insulation layers.

Moreover, in order to achieve the above-mentioned object, according to an eighth aspect of the present invention, in the seventh aspect of the present invention, the plurality of conductive layers of the elastic connection member abut against the electrodes so that the electric connections therebetween are established.

Furthermore, in order to achieve the above-mentioned object, according to a ninth aspect of the present invention, there is provided an electronic device which is equipped with the switch structure according to any one of the first to eighth aspects of the present invention.

The switch structure according to the present invention is obtained by providing the elastic connection member between the push switch and the end surface of the circuit board. With this constitution, when the push switch is pushed, the elastic connection member deforms to absorb the force. Therefore, even if the push switch is pushed strongly, the switch portion hardly breaks. Further, unlike the conventional example, the switch module is not soldered on the circuit board 1. As a result, even in the case of the strong depression described above, there occurs no failure including a case where soldered portions of the electrodes are damaged. Consequently, there can be provided the switch structure resistant to a strong pressure and impact compared to the conventional example, and the electronic device including the side switch excellent in impact resistance.

DETAILED DESCRIPTION OF THE PREFERRED EMBODIMENTS

A switch structure according to embodiments of the present invention and an electronic device including the switch structure according to the embodiment of the present invention will be explained referring to FIGS. 1 to 6.

Figure 1:
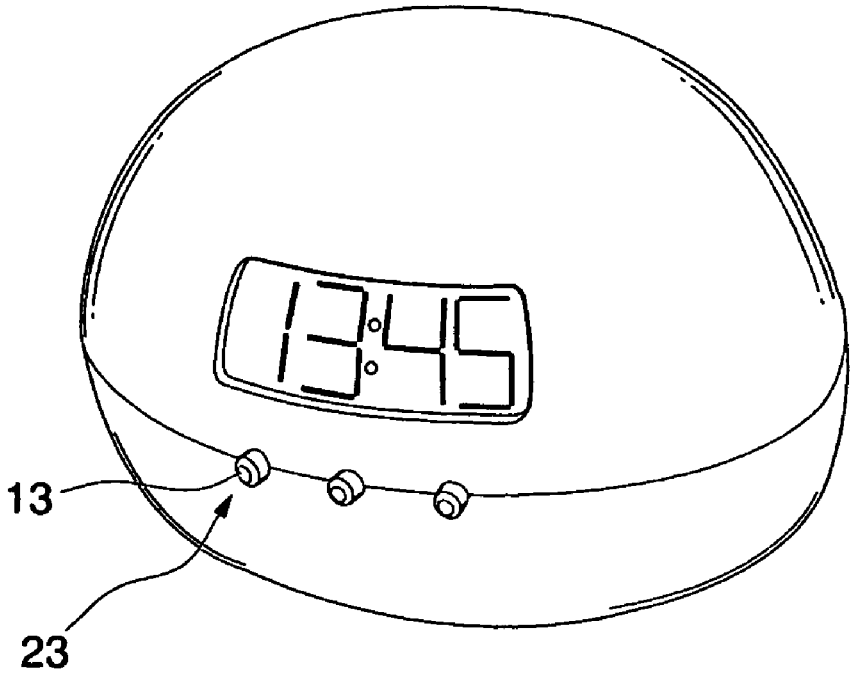
FIG. 1 is a perspective view of a portable device including a switch structure according to an embodiment of the present invention.

FIG. 1 is an outer perspective view of the electronic device including the switch structure of the embodiment of the present invention. The electronic devices such as a portable phone, an electronic metronome, and a stopwatch may include a push-button-type side switch 23 on a side surface of a case of the electronic device. To use the side switch 23, one side surface of the case of the electronic device is held by a palm or a finger, and the side switch 23 on an opposite side surface is pushed by a finger.

Figure 2:
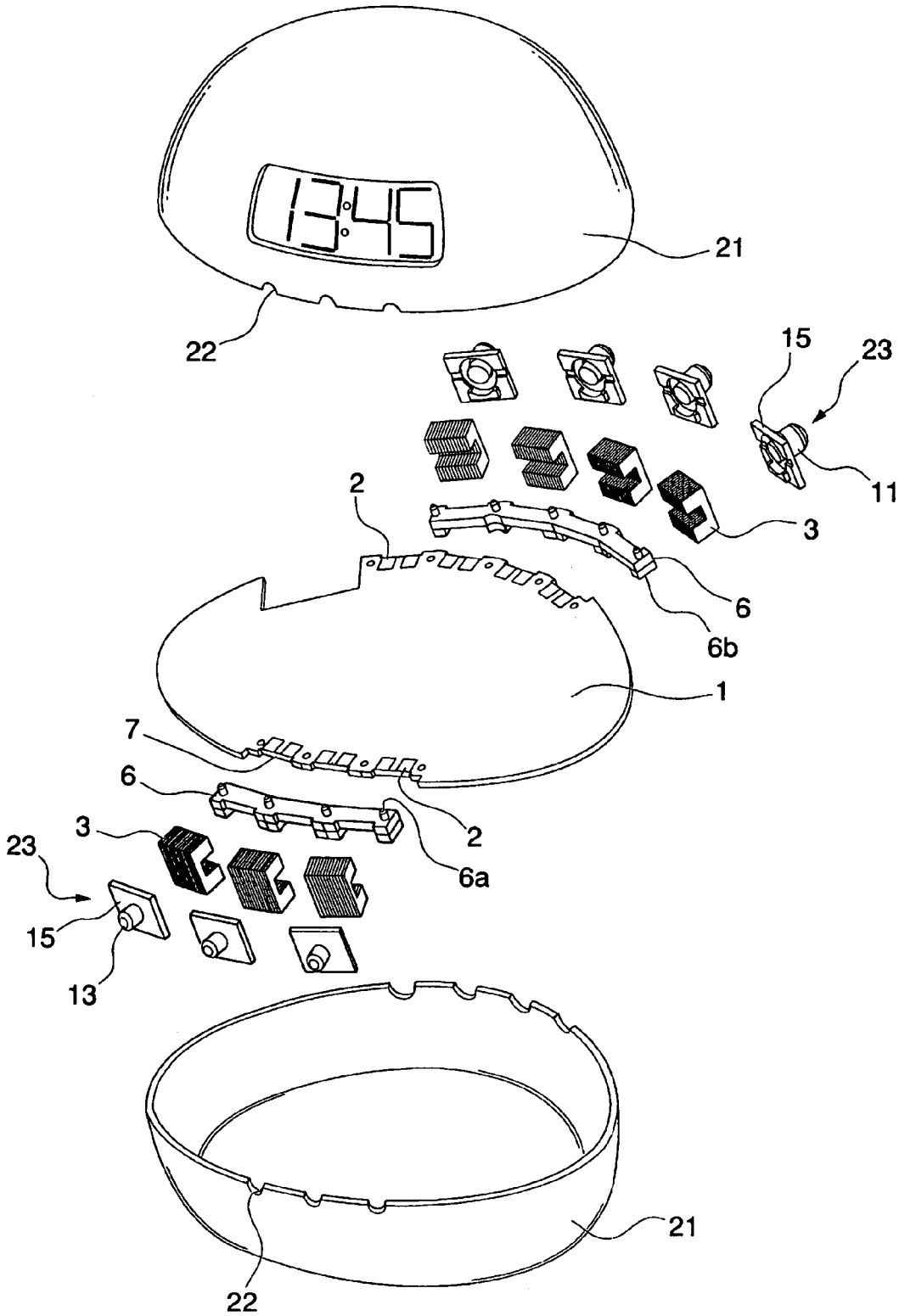
FIG. 2 is an exploded view showing a mounting structure of the switch structure according to the embodiment of the present invention onto the portable device.
Figure 3A:
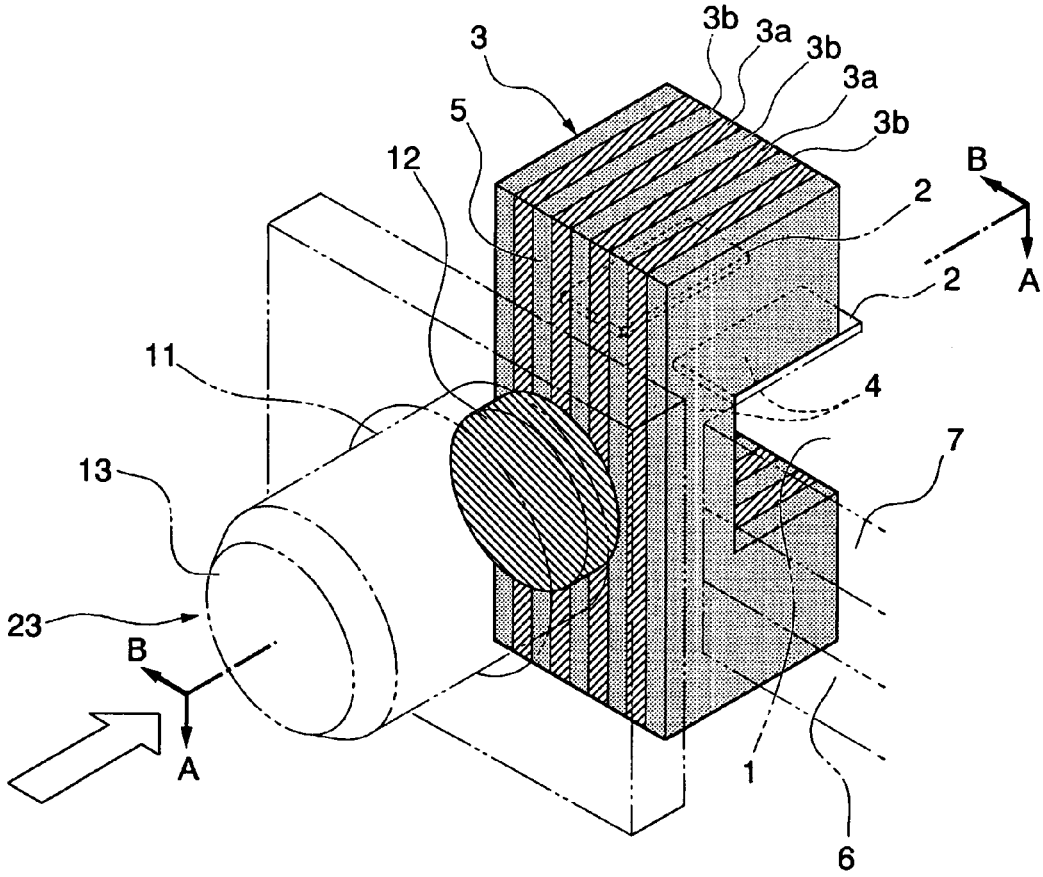
FIG. 3A is an enlarged view showing the switch structure according to the embodiment of the present invention.
Figure 3B:
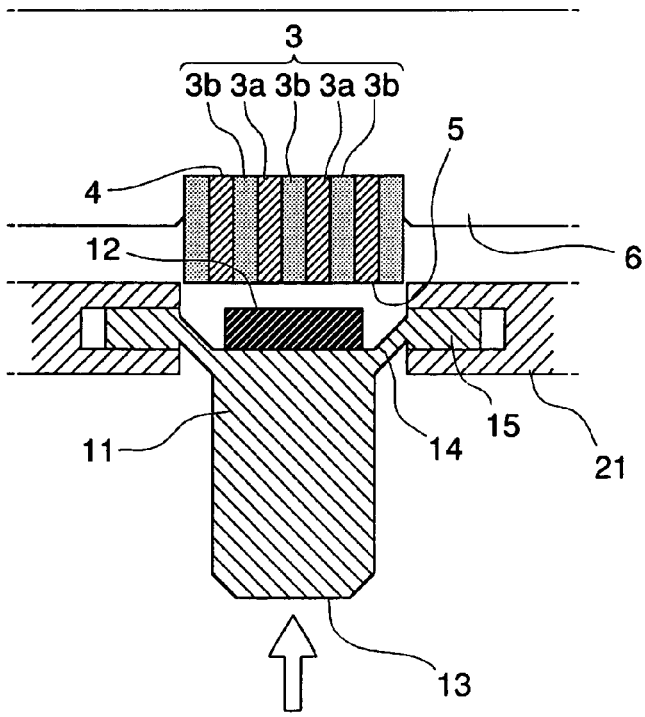
FIG. 3B is a sectional view showing the switch structure according to the embodiment of the present invention taken along the line A-A of FIG. 3A.
Figure 4:
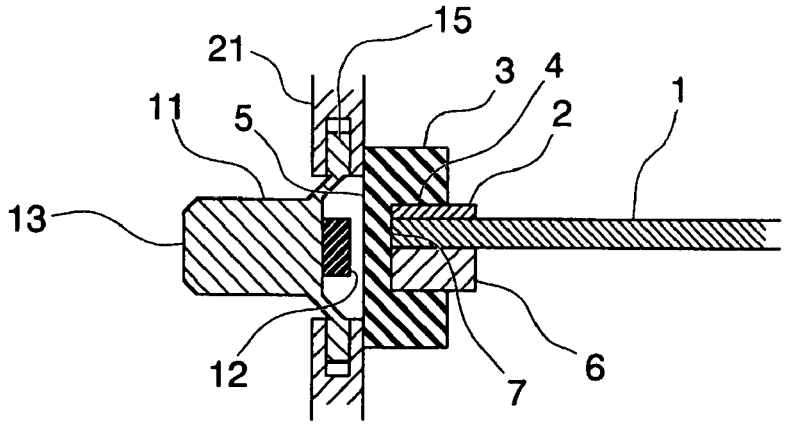
FIG. 4 is a sectional view showing the switch structure according to the embodiment of the present invention taken along the line B-B of FIG. 3A.

FIG. 2 is an exploded view showing amounting structure of the switch structure according to the embodiment of the present invention onto the portable device. Further, FIG. 3A is an enlarged view showing the switch structure according to the embodiment of the present invention. FIG. 3B is a sectional view of FIG. 3A taken along the line A-A. FIG. 4 is a sectional view showing the switch mechanism according to the embodiment of the present invention taken along the line B-B of FIG. 3A.

A schematic structure of the switch structure according to the embodiment of the present invention will be explained referring to FIGS. 2, 3A, 3B, and 4. A circuit board 1 is provided with a pair of electrodes 2 and a support member 6. The pair of electrodes 2 are provided on a circuit pattern formation surface or an opposite surface of the circuit board 1. The support member 6 is provided on an opposite surface of the surface on which the pair of electrodes 2 are provided. An elastic connection member 3 having a squared C shape is provided so as to sandwich the pair of electrodes 2 and the support member 6.

A push switch 11 constituting the side switch 23 is fixed so that a push switch base portion 15 is interposed in a case 21. The elastic connection member 3 presents between the push switch 11 and a circuit board end surface 7. The push switch 11 is fixed so that a contact portion 12 abuts against a second lamination layer surface 5 of the elastic connection member 3 when the push switch 11 is in a pushed state (ON state). A push switch upper portion 13 is ejected outside of the case 21 through a switch hole 22 of the case 21.

The elastic connection member 3 is structured by alternately laminating conductive layers 3*a* and insulation layers 3*b*. Surfaces on which both the conductive layers 3*a* and the insulation layers 3*b* are exposed are referred to as lamination layer surfaces. Among the lamination layer surfaces, a surface abutting against the electrodes 2 and a surface adjacent to the surface and abutting against the circuit board 1 are both referred to as first lamination layer surfaces 4. In a case where the electrodes 2 are formed on the circuit board end surface 7, only a surface abutting against the circuit board end surface 7 constitutes the first lamination layer surface 4. Further, a surface opposing the first lamination layer surface 4 against which the contact portion 12 of the push switch 11 abuts is referred to as the second lamination layer surface 5. As shown in FIG. 3, one first conductive layer or a plurality of first conductive layers may be provided, and one second conductive layer or a plurality of second conductive layers may be provided.

In a case where the first lamination layer surface 4 abuts against the electrodes 2, the electric connections between the conductive layers 3*a* of the first lamination layer surface 4 and the electrodes 2 are established. There are the plurality of conductive layers 3*a*, and each of the pair of electrodes 2 abuts against the different conductive layers 3*a*. In this case, the conductive layer 3*a* abutting against one electrode 2 is referred to as a first conductive layer, and the conductive layer 3*a* abutting against another electrode 2 is referred to as a second conductive layer.

In a case where the push switch 11 is pushed, the contact portion 12 of the push switch 11 abuts against the second lamination layer surface 5 of the elastic connection member 3 so that the electric connections between the first conductive layer and the second conductive layer are established. As a result, in the case where the push switch 11 is pushed, the pair of electrodes 2 on the circuit board 1 are conductive to each other via the plurality of conductive layers 3*a* being electrically connective due to the contact portion 12.

The circuit board 1 is a board such as a print circuit board on which electric components of an electronic device are implemented. The electrodes 2 are formed on an implementation surface of the circuit board 1 on which electronic components are implemented or on an opposite surface of a surface on which the electrodes 2 are provided. In FIG. 2, the electrodes 2 are formed in an end surface of the circuit board 1 to the vicinity thereof. The electrodes 2 can be formed on a position of the circuit board 1 where the electrodes 2 can abut against the elastic connection member 3. The electrodes 2 are provided as a pair. The switch structure of the embodiment of the present invention can establish the electric connections between the pair of electrodes 2.

In this embodiment, the elastic connection member 3 has a squared C shape, but the elastic connection member 3 may take an alternate shape as long as the elastic connection member 3 sandwiches the electrodes 2 provided on the circuit board 1 and the support member 6.

Each of the conductive layers 3*a* of the elastic connection member 3 is formed by mixing a conductive material in an elastic base material such as a rubber or a thermoplastic elastomer. For example, each of the conductive layers 3*a* can be formed by kneading carbon in a silicon rubber. Each of the conductive layers 3*a* of the elastic connection member 3 can alternatively be formed by not only those materials but also other conductive and elastic materials. Similarly, each of the insulation layers 3*b* can be formed by a rubber or the like having an insulating property and elasticity.

Further, in the embodiment of the present invention, the conductive layers 3*a* and the insulation layers 3*b* have the same thickness. However, they do not necessarily have the same thickness. For example, even if each of the insulation layers 3*b* is a thin layer formed of an insulating membrane or the like, the elastic connection member 3 of the embodiment of the present invention can be structured. In this case, a width of each of the conductive layers 3*a* can be enlarged, and there is an advantage in that a contact resistance between the conductive layers 3*a* and the electrodes 2 or the contact portion 12 can be lowered.

The elastic connection member 3 includes, in order to conduct the pair of electrodes 2, at least the two conductive layers 3*a* and the insulation layer 3*b* therebetween. In the embodiment of FIG. 2, the plurality of conductive layers 3*a* and the plurality of insulation layers 3*b* are provided. The thickness of each of the conductive layers 3*a* is approximately equal to or smaller than a width of each of the electrodes 2.

The first lamination layer surface 4 on which the conductive layers 3*a* and the insulation layers 3*b* of the elastic connection member 3 are exposed abuts against the circuit board 1. The conductive layers 3*a* on the first lamination layer surface 4 abut against the electrodes 2 so that the electric connections therebetween are established. Electrode of the pair of electrodes 2 abut against the different conductive layers 3*a*, respectively.

In the case where the elastic connection member 3 is formed of the plurality of different conductive layers 3*a*, one or a plurality of the conductive layers 3*a* of those abut against the electrodes 2 so that the electric connections therebetween are established.

The support member 6 is provided on a surface of the circuit board 1 which is an opposite surface of the surface on which the electrodes 2 are provided. On a surface of the support member 6 of the circuit board 1 side, there is provided a first convex portion 6*a* which can be inserted in and fixed to a hole provided in the circuit board 1. The support member 6 also includes a second convex portion 6*b* which abuts against the elastic connection member 3 on a surface opposing the first convex portion 6*a*.

The push switch 11 is formed of an insulating elastic body such as a rubber or an elastomer resin. The push switch 11 includes a swelled portion, the contact portion 12, a skirt portion 14, and a push switch base portion 15. The swelled portion includes a button upper portion having a dome shape. The contact portion 12 is formed on a lower surface side of a button. The skirt portion 14 surrounds the contact portion 12. The push switch base portion 15 supports the skirt portion 14. In the push switch 11, the push switch skirt portion 14 has elasticity. When the push switch upper portion 13 is pushed, the push switch skirt portion 14 deforms, the contact portion 12 is pushed down, and the contact portion 12 abuts against the elastic connection member 3. Upon releasing a force for pushing the push switch upper portion 13, the push switch skirt portion 14 return to the original position, and therefore the contact portion 12 moves backward and is detached from the elastic connection member 3.

In FIG. 2, the push switch upper portion 13 has a flat shape. However, the shape thereof is not restricted as long as the button upper portion has a dome like shape and the button can be pushed down. The contact portion 12 has conductivity and is formed by carbon, a metal, or the like.

It should be noted that in FIG. 2, the push switch 11 is fixed by being interposed in the case 21. However, the push switch 11 may be fixed in a different manner as long as the contact portion 12 abut against the elastic connection member 3 by pushing the push switch upper portion 13. For example, the switch structure is attained by directly fixing the push switch 11 to the elastic connection member 3.

Further, in a case where there are the plurality of switch structures according to the embodiment of the present invention as shown in FIG. 2, the push switches 11 may be structured by connecting with each other with the respective push switch base portions 15. In this case, by using a long member as the support member 6, it is possible to incorporate the plurality of elastic connection members 3 into one support member 6. In this case, a convex portion, which is used to decide an installation position of each of the elastic connection members 3, may be provided.

Still further, in the case where there are the plurality of switch structures according to the embodiment of the present invention, it is possible to attain the switch structure by using a long elastic connection member 3 and the plurality of pairs of electrodes 2. In this case, one elastic connection member 3 contacts the plurality of electrodes 2 aligning on one circuit board 1. The elastic connection member 3 has a constitution in which the conductive layers 3*a* and the insulation layers 3*b* are alternately laminated. Accordingly, the plurality of pairs of electrodes 2 can compose a plurality of switches by using the one elastic connection member 3.

Referring to FIGS. 3A, 3B, and 4, the electric connections established between the pair of electrodes 2 in the switch structure constituted as mentioned above will be explained. The pair of electrodes 2 abut against two conductive layers 3*a* of elastic connection member 3 exposed on the first lamination layer surface 4 so that the electric connections therebetween are established, respectively (FIG. 3B). In a case where the push switch 11 is in an unpushed state (OFF state), the contact portion 12 does not abut against the second lamination layer surface 5 of the elastic connection member 3, and the conductive layers 3*a* are insulated with each other.

When the push switch upper portion 13 is pushed down with a finger or the like, the skirt portion 14 of the push switch 11 deforms, and the contact portion 12 abuts against the elastic connection member 3. The contact portion 12 abuts against the plurality of conductive layers 3*a* of the elastic connection member 3 so that the electric connections therebetween are established, whereby the electric connections between conductive layers 3*a* are established.

In a state where the push switch 11 is pushed, all of four conductive layers 3*a* shown in FIG. 3B abut against the contact portion 12, and the electric connections between the conductive layers 3*a* are established. As a result, the electric connections between two electrodes 2 are established.

In this case, as the number of the conductive layers 3*a* and the insulation layers 3*b* contacting the electrodes 2 is larger, precision of the positional relation between the electrodes 2 and the elastic connection member 3 in a perpendicular direction with respect to the lamination layer surface can be lower. The reason is as follows. That is, in the positional relation between the elastic connection member 3 and the electrodes 2, even if the elastic connection member 3 shifts in the perpendicular direction with respect to the lamination layer surface, the electrical connections therebetween can be secured as long as any one of the conductive layers 3*a* connects each of the electrodes 2. Therefore, it is possible to readily incorporate the elastic connection member 3 into the circuit board 1.

Further, the use of the support member 6 enables the elastic connection member 3 to abut against the electrodes 2 with stability. In addition, the second convex portion 6*b* of the support member 6 makes it possible to decide the installation position of the elastic connection member 3, whereby the elastic connection member 3 can be readily installed.

The support member 6 can also be installed in and fixed to the circuit board 1 as follows. That is, An installation hole is provided to the circuit board 1 and the first convex portion 6*a* of the support member 6 is inserted therein.

According to the structure of the embodiment of the present invention, even if the push switch 11 is pushed strongly, the elastic connection member 3 deforms to absorb most of the force and the impact. Therefore, a switch structure having a high impact resistance can be obtained. Further, the switch structure also has an advantage in that there are few damaged portions as compared to the conventional switch having an adherence portion between the electrodes 2 and a switch portion due to soldering or the like.

Further, according to the switch structure of the embodiment of the present invention, the elastic connection member 3 deforms in the ON state and abuts against the contact portion 12 in a bouncing manner. Therefore, there is also an advantage in that contacting and abutting is stably performed to prevent momentarily blackout and chattering from occurring.

Figure 5:
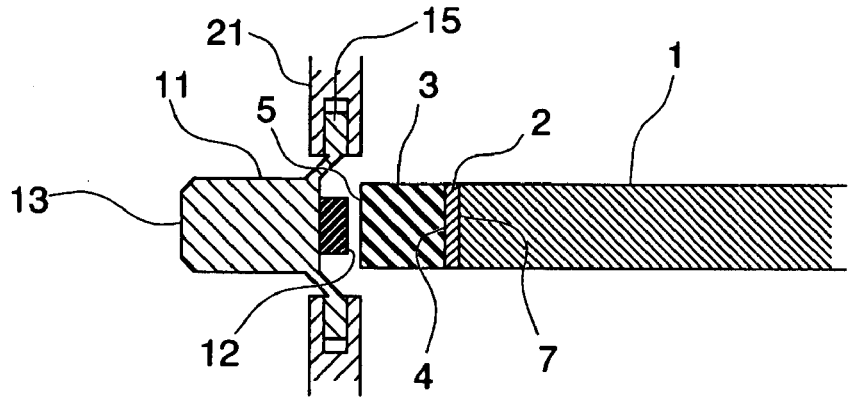
FIG. 5 is a sectional view of the switch structure according to a first modification example of the embodiment of the present invention.

FIG. 5 is a sectional view of a first modification example of the embodiment of the present invention. It should be noted that in this modification example and also in the following modification example, components similar to those in the above-mentioned embodiment are denoted by the similar reference numerals and description thereof will be omitted. The electrodes 2 are provided on the circuit board end surface 7 perpendicular to a pattern printing surface of the circuit board 1. The elastic connection member 3 is interposed between the push switch 11 and the electrodes 2.

The first modification example has such a structure that the electrodes 2, the elastic connection member 3, and the push switch 11 are provided in a straight line. Therefore, the elastic connection member 3 does not need to have the above-mentioned squared C shape. It is only necessary that the first lamination layer surface 4 abut against the electrodes 2 so that the electric connections between are established, and the second lamination layer surface 5 abut against the contact portion 12 of the push switch 11 pushed so that the electric connections therebetween are established. For example, in a case of the elastic connection member 3 having a shape of a rectangular parallelepiped, the switch structure according to the present invention can be constituted.

In the first modification example, the switch structure of the present invention can be achieved even without the support member 6. However, in a case where the circuit board 1 is thin and the like, the support member 6 can be used for stably fixing the elastic connection member 3.

Figure 6:
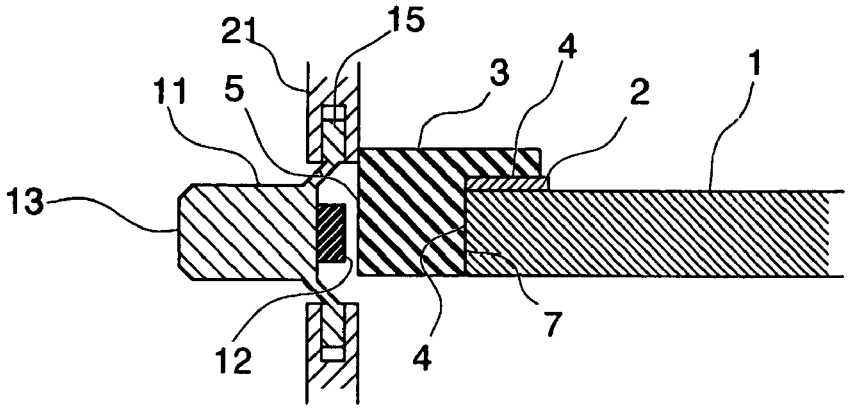
FIG. 6 is a sectional view of the switch structure according to a second modification example of the embodiment of the present invention.
Figure 7:
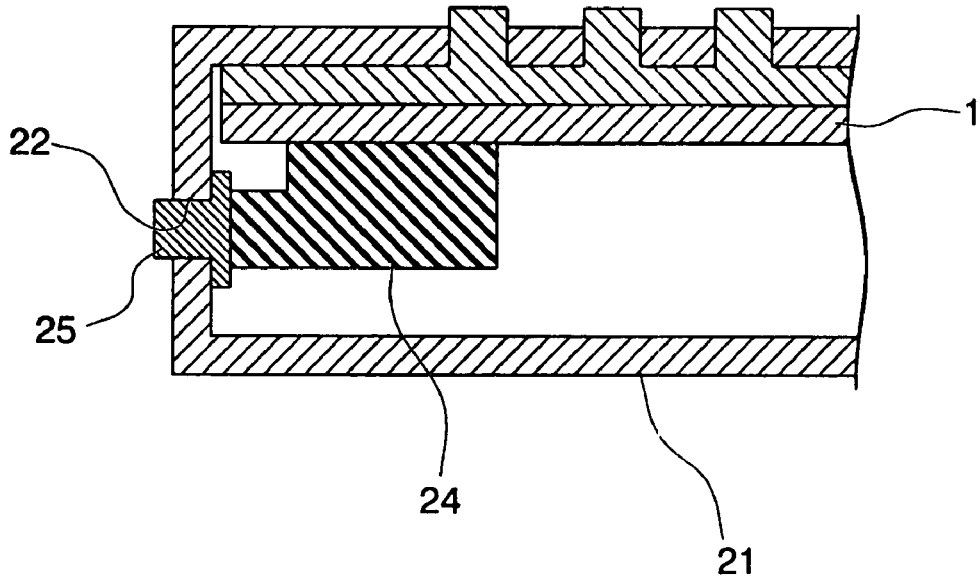
FIG. 7 PRIOR ART
FIG. 7 is a sectional view of a switch structure of a related art.

FIG. 6 is a sectional view of a second modification example of the embodiment of the present invention. In this modification example, the electrodes 2 of the first modification example are provided on the pattern printing surface of the circuit board 1. Therefore, the elastic connection member 3 abuts against two surfaces, that is, the circuit board end surface 7 of the circuit board 1 and the implementation surface on which the electrodes 2 are provided. In FIG. 6, the elastic connection member 3 has an L shape. The elastic connection member 3 may have an alternative shape as long as the elastic connection member 3 abuts against the circuit board end surface 7 and the implementation surface on which the electrodes 2 are provided of the circuit board 1.

With the elastic connection member 3 having the L shape, there is an effect that the area of the electrodes is increased compared with a case of the first modification example in which the electrodes 2 are provided on the circuit board end surface 7 of the circuit board 1.

What is claimed is:

1. A switch structure, comprising:

a circuit board;

at least a pair of electrodes formed on the circuit board;

a push switch provided to face an end surface of the circuit board, and having a contact portion which moves forward and backward; and an elastic connection member provided between the end surface of the circuit board and the contact portion, and has a structure in which conductive layers including a first conductive layer and a second conductive layer and insulation layers are laminated alternately, wherein the elastic connection member is constituted such that, the first conductive layer abuts against one electrode of the pair of electrodes out of the plurality of electrodes, and the second conductive layer insulated from the first conductive layer abuts against another electrode of the pair of electrodes out of the plurality of electrodes, and when the push switch is pushed, the contact portion abuts against the first conductive layer and the second conductive layer so that electric connections therebetween are established.

2. A switch structure according to claim 1, wherein the electrodes are provided on the end surface of the circuit board.

3. A switch structure according to claim 1, wherein the electrodes are provided on a circuit pattern formation surface of the circuit board, and abut against a lamination layer surface of the elastic connection member where the conductive layers and the insulation layer are exposed.

4. A switch structure according to claim 3, wherein the elastic connection member abuts against an opposite surface of the surface of the circuit board, on which the electrodes are formed.

5. A switch structure according to claim 3, further comprising a support member on an opposite surface of the surface of the circuit board, on which the electrodes are provided.

6. A switch structure according to claim 5, wherein the support member has a length larger than a width of the elastic connection member, and includes a convex portion adjacent to the end surface of the elastic connection member.

7. A switch structure according to claim 6, wherein the elastic connection member includes the plurality of conductive layers and the plurality of insulation layers.

8. A switch structure according to claim 7, wherein the plurality of conductive layers of the elastic connection member abut against the electrodes so that the electric connections therebetween are established.

9. An electronic device, which is equipped with the switch structure according to claim 1.

* * * * *